US007971829B2

(12) United States Patent
See et al.

(10) Patent No.: US 7,971,829 B2
(45) Date of Patent: Jul. 5, 2011

(54) CENTER-ROUTED KITE SAFETY DEVICE

(76) Inventors: Dano See, Cardiff (AU); Amery Bernard, Portland, OR (US)

( * ) Notice: Subject to any disclaimer, the term of this patent is extended or adjusted under 35 U.S.C. 154(b) by 816 days.

(21) Appl. No.: 11/975,076

(22) Filed: Oct. 17, 2007

(65) Prior Publication Data

US 2008/0035796 A1 Feb. 14, 2008

(51) Int. Cl.
*A63H 27/08* (2006.01)

(52) U.S. Cl. ..... 244/155 A

(58) Field of Classification Search ..... 244/153 R, 244/155 R, 155 A

See application file for complete search history.

(56) References Cited

U.S. PATENT DOCUMENTS

| | | | | |
|---|---|---|---|---|
| 6,260,803 | B1 * | 7/2001 | Hunts | 244/155 R |
| 6,273,369 | B1 * | 8/2001 | Nishimura et al. | 244/155 A |
| 6,513,759 | B2 * | 2/2003 | Starbuck | 244/155 A |
| 6,581,879 | B2 * | 6/2003 | Bellacera | 244/155 A |
| 6,691,954 | B1 * | 2/2004 | Harrington et al. | 244/155 A |
| 6,745,713 | B2 * | 6/2004 | Starbuck | 114/39.16 |
| 6,830,220 | B2 * | 12/2004 | Runyan | 244/155 A |
| 6,869,047 | B2 * | 3/2005 | Pouchkarev | 244/155 A |
| 6,877,697 | B2 * | 4/2005 | Bellacera | 244/155 A |
| 6,988,694 | B2 * | 1/2006 | Barrs et al. | 244/155 A |
| 7,036,771 | B1 * | 5/2006 | Pouchkarev | 244/155 A |
| 7,182,294 | B2 * | 2/2007 | Blackman | 244/155 A |
| 7,581,701 | B2 * | 9/2009 | Logosz et al. | 244/155 A |
| 2004/0182968 | A1 * | 9/2004 | Gentry | 244/155 A |
| 2004/0195459 | A1 * | 10/2004 | Pouchkarev | 244/153 R |
| 2005/0040291 | A1 * | 2/2005 | Hansel | 244/155 A |
| 2006/0226294 | A1 * | 10/2006 | Logosz et al. | 244/152 |
| 2006/0243862 | A1 * | 11/2006 | Roger | 244/155 A |
| 2007/0120016 | A1 * | 5/2007 | Eberle et al. | 244/153 R |
| 2008/0067291 | A1 * | 3/2008 | Logosz et al. | 244/155 A |

FOREIGN PATENT DOCUMENTS

DE 10162859 C1 * 6/2003

* cited by examiner

*Primary Examiner* — Tien Dinh
*Assistant Examiner* — Joseph W Sanderson

(57) ABSTRACT

A control device for use with an aerodynamic wing including a bar having a safety system that restrains one of the flying lines by routing an attachment through an aperture on the bar. Preferably, the system includes a stopper housing that engages an increased diameter element of the flying line. During normal operation, the increased diameter element is secured by the stopper housing, preventing the flying line from being pulled beyond the stopper housing. When the safety system is deployed, the increased diameter element is pulled from the stopper housing and slack is developed along the remaining flying lines to depower the kite.

16 Claims, 4 Drawing Sheets

CENTER-ROUTED KITE SAFETY DEVICE

FIELD OF THE PRESENT INVENTION

The present invention relates generally to devices for controlling inflatable power or traction kites. More particularly, the invention relates to a bar for controlling a kite having a safety system with improved features.

BACKGROUND OF THE INVENTION

Considerable effort is being expended to develop wings capable of generating tractive force for the purposes of powering a user on a variety of vehicles that are tethered solely by flexible lines. Such wings can generally be considered kites. The development of kites capable of generating significant force has made possible numerous recreational pursuits. For example, kite surfing or kite boarding refers to a sport involving the use of a wind powered wing to pull the participant on a vehicle across a body of water. Similar sports involving the use of appropriately configured vehicles to traverse sand, earth, snow and ice are also being pursued. One of skill in the art will also recognize that wind powered wings can be used in any number of other applications, whether recreational or practical. With the development of these applications has come an increasing demand for kites having improved characteristics.

One type of kite that has achieved popularity is a leading edge inflatable ("LEI") kite, typically comprising a semi-rigid framework of inflatable struts or spars that support a canopy to form the profile of the wing. This basic design is disclosed in U.S. Pat. No. 4,708,078 to Legaignoux, et al. The development of the LEI kite is generally credited with spurring the development of modern kite surfing due to its ability to be relaunched from the water's surface.

Most LEI kites currently employ four or five lines to control the kite. Two steering lines are attached at opposing ends of the kite at the trailing edge and at opposing ends of a control bar. Two front lines are attached at opposing ends of the kite at the leading edge and are secured to the middle of the control bar or to the user. The kite is steered by pivoting the control bar about a central axis to transmit force along the steering lines to the trailing edge of the kite. Further, by varying the relative length of the steering lines with respect to the front lines, the angle of attack of the kite can be adjusted, or "trimmed." This has the effect of providing control over the amount of lifting force developed by the kite. Most kite control systems have a "fixed" adjustment mechanism for setting the trim of the kite by using a cleat, adjustable strap, or the like, which is positioned above the bar, meaning between the bar and the kite. Most control systems also provide "variable" dynamic trim adjustment by providing an attachment for the front lines to the user, typically through a "chicken loop." Thus, the trim of the kite is constantly adjusted by moving the control bar in and out from the user's body.

The issue of safety is an important factor in the design of a LEI kite system. Power kites are capable of generating large forces that contribute to the enjoyment of the sport. However, these same forces can also pose significant safety hazards to the user and to bystanders when inadequate control is provided. This can occur if the wind strength increases beyond an acceptable amount, if the user does not or cannot utilize the control system appropriately or if the control system becomes compromised, such as by twisting, tangling or breaking the lines. Therefore, most kite designs and control systems offer a means for substantially reducing the amount of power exerted by the kite. Proven safety designs include methods of restraining one of either the front lines or the steering lines while allowing a significant amount of slack in the remaining lines. Ideally, this has the effect of corrupting the aerodynamic profile of the kite so that essentially all the lifting forces are extinguished.

However, the conventional safety depower systems suffer from a number of drawbacks, including the possibility that the kite will not adequately depower, the significant chance that the lines will become tangled and the difficulty in relaunching the kite after it has been depowered. In particular, the choice of how to restrain one of the flying lines while allowing slack in the remaining lines presents significant design challenges.

Most commonly, a separate tether attached to the user is run to one of the flying lines. The designated flying line is equipped with a one-way stopping device that positively restrains the flying line when tension is applied from the flying direction but allows the flying line to be freely drawn in towards the user. As can be appreciated, the flying line remains butted against the stop during normal flight, and the user can control the kite in a normal manner. To activate the safety system, the user simply drops the control bar and releases any chicken loop attachment. At this point, the only attachment to the kite is the safety tether secured to one of the flying lines. As the control bar is pulled away from the user by the tension in the flying lines, significant slack develops in all the lines except for the one secured by the tether. This arrangement prevents the kite from maintaining an effective aerodynamic profile and the kite is unable to generate significant power.

Despite the general effectiveness of these prior art safety designs, the attachment of the safety tether to the flying line is awkward and raises the risk of tangling either with the user or with the other kite control mechanisms. If the tether becomes so tangled that the line cannot pull smoothly back from the stop, then the ability of the system to depower the kite is compromised and may not effectively protect the user during deployment.

Another difficulty posed by the conventional depower systems is the twisting of flying lines that can occur during normal kite operation. Often, users perform maneuvers such as front and back flips, spins and kite loops that impart one or more twists in the control lines. To remove the twist, the user typically rotates the control bar in the counter direction. Unfortunately, the presence of the safety tether can interfere with this process, leaving the tether twisted about the control lines. Correspondingly, this interferes with the user's ability to control the kite and undermines the safety system as described above.

Accordingly, what has been needed is a kite safety system that integrates well with existing kite control bars, but offers improved performance.

Thus, it is an object of the present invention to provide a kite safety system that effectively depowers a kite while minimizing the potential for tangles and twists.

It is another object of the present invention to provide a control system for a kite with a safety system that fully depowers the kite.

It is also an object of the present invention to provide a method for controlling a kite that offers improved safety.

A further object of the invention is to provide a method and system for providing a safety depower system for a kite at a location proximal to the user from the control bar.

SUMMARY OF THE INVENTION

In accordance with the above objects and those that will be mentioned and will become apparent below, the present invention is a safety system for depowering an aerodynamic wing such as a kite including a control device with a bar with opposing ends adapted to apply steering forces to the aerodynamic wing, at least two flying lines used to transmit forces to and from the aerodynamic wing, a stopper housing secured to the control device and a flying line extension extending from a first flying line of the at least two flying lines through an aperture on the bar, wherein the first flying line is routed through the stopper housing and wherein the first flying line has an increased diameter element configured to engage the stopper housing and prevent travel of the increased diameter element through the stopper housing.

Preferably, the stopper housing has a large bore portion and a small bore portion, wherein the small bore portion prevents travel of the increased diameter element through the stopper housing. Also preferably, the large bore portion is configured to engage the increased diameter element of the first flying line with friction and releasably retain the increased diameter element. Also preferably, the increased diameter element has a diameter less than the diameter of the aperture on the bar.

In one embodiment of the invention, the increased diameter portion of the first flying line less than approximately four times the diameter of the first flying line and preferably is approximately two times the diameter of the first flying line.

In another embodiment of the invention, the flying lines comprise two steering lines disposed at the opposing end of the bar and two front lines. Preferably, the control device further comprises a chicken loop line extending through the aperture on the bar and secured to the front lines. In the noted embodiments, the effective length of the chicken loop line is preferably adjustable. In a further aspect of the invention, the chicken loop line and the front lines are connected by a front line attachment. Preferably, the front line attachment further comprises the stopper housing.

In one embodiment of the invention, the chicken loop line is secured to a chicken loop, travels through the aperture on the bar, through a pulley above the bar to which the front lines are secured, back through the aperture and is secured by a releasable attachment located adjacent the chicken loop, wherein the front line attachment further comprises the pulley. Preferably, the chicken loop line is secured to the chicken loop by a housing and the releasable attachment is secured to the housing, and wherein the housing comprises an aperture through which the flying line extension extends. Also preferably, the invention includes a stopper running along the chicken loop line and wherein the stopper has an aperture through which the flying line extension extends.

The invention also includes a method for controlling an aerodynamic wing comprising the steps of providing a bar having opposing ends adapted to apply steering forces to the aerodynamic wing, at least two flying lines used to transmit forces to and from the aerodynamic wing, a stopper housing secured to the control device and a flying line extension extending from a first flying line of the at least two flying lines through an aperture on the bar, wherein the first flying line is routed through the stopper housing and wherein the first flying line has an increased diameter element configured to engage the stopper housing and prevent travel of the increased diameter element through the stopper housing, attaching a safety tether between a user and the flying line extension to restrain the first flying line, and depowering the aerodynamic wing by releasing the bar so that the first flying line runs through the stopper housing and the aperture to create slack in flying lines other than the first flying line.

Preferably, the methods of the invention further comprise the step of pulling in the bar so that the first flying line travels through the aperture in the stopper housing until the increased diameter element of the flying line engages the stopper housing and allows normal control of the aerodynamic wing.

In another embodiment, the invention is a control device for use with an aerodynamic wing comprising a bar with opposing ends adapted to apply steering forces to the aerodynamic wing, at least two flying lines used to transmit forces to and from the aerodynamic wing, a depower line secured to one of the flying lines that extends through an aperture on the bar, so that depower line restrains one of the flying lines and develops sufficient slack in the remaining flying lines to depower the aerodynamic wing when the bar is released. Preferably, the flying line is routed through a stopper housing and then secured to the depower line with an increased diameter element, wherein the increased diameter element is configured to engage the stopper housing and prevent travel of the increased diameter element through the stopper housing. Also preferably, the stopper housing is secured to a chicken loop line that is routed through an aperture on the bar. Alternatively, the flying line is secured to the bar at an end and depower line is fixedly attached to one of the flying lines at a distal location.

BRIEF DESCRIPTION OF THE DRAWINGS

Further features and advantages will become apparent from the following and more particular description of the preferred embodiments of the invention, as illustrated in the accompanying drawings, and in which like referenced characters generally refer to the same parts or elements throughout the views, and in which.

DETAILED DESCRIPTION OF THE INVENTION

Before describing the present invention in detail, it is to be understood that this invention is not limited to particularly exemplified materials, methods or structures as such may, of course, vary. Thus, although a number of materials and methods similar or equivalent to those described herein can be used in the practice of the present invention, the preferred materials and methods are described herein.

It is also to be understood that the terminology used herein is for the purpose of describing particular embodiments of the invention only and is not intended to be limiting.

Unless defined otherwise, all technical and scientific terms used herein have the same meaning as commonly understood by one having ordinary skill in the art to which the invention pertains.

Further, all publications, patents and patent applications cited herein, whether supra or infra, are hereby incorporated by reference in their entirety.

Finally, as used in this specification and the appended claims, the singular forms “a”, “an” and “the” include plural referents unless the content clearly dictates otherwise.

As used herein, the term “cleat” is meant to mean and include any readily releasable attachment mechanism for temporarily securing a line in a desired position. As such, these devices include, without limitation, friction cleats, cam cleats, buckles or the like, such that the length of a line can be mechanically fixed at a desired amount and subsequently released.

As used herein, the term "chicken loop line" is meant to mean and include any line configured to transmit tractive force from the front lines to the user.

As used herein, the term "chicken loop" is meant to mean and include any attachment point for releasably securing the kite to a user, so that the tractive force generated by the kite is transmitted to the user during normal operation. In one embodiment, the chicken loop line is reinforced with tubing and formed into a loop to allow easy engagement with a harness hook. In another embodiment, the chicken loop line is terminated in a metal ring that is designed to cooperate with a releasable shackle secured to the user. Any other suitable attachment mechanisms are also included. This term is not meant to include a safety line or attachment designed to depower the kite when the control bar is released.

The present invention is a safety system for use in conjunction with a control bar for a kite wherein one of the flying lines is restrained when the system is deployed. The restraint for the flying line is routed through an aperture in the control bar. By routing the flying line restraint and other lines associated with the control bar, such as the chicken loop lines, the risk of tangling or imparting twists to the lines is significantly reduced.

Figure 1:
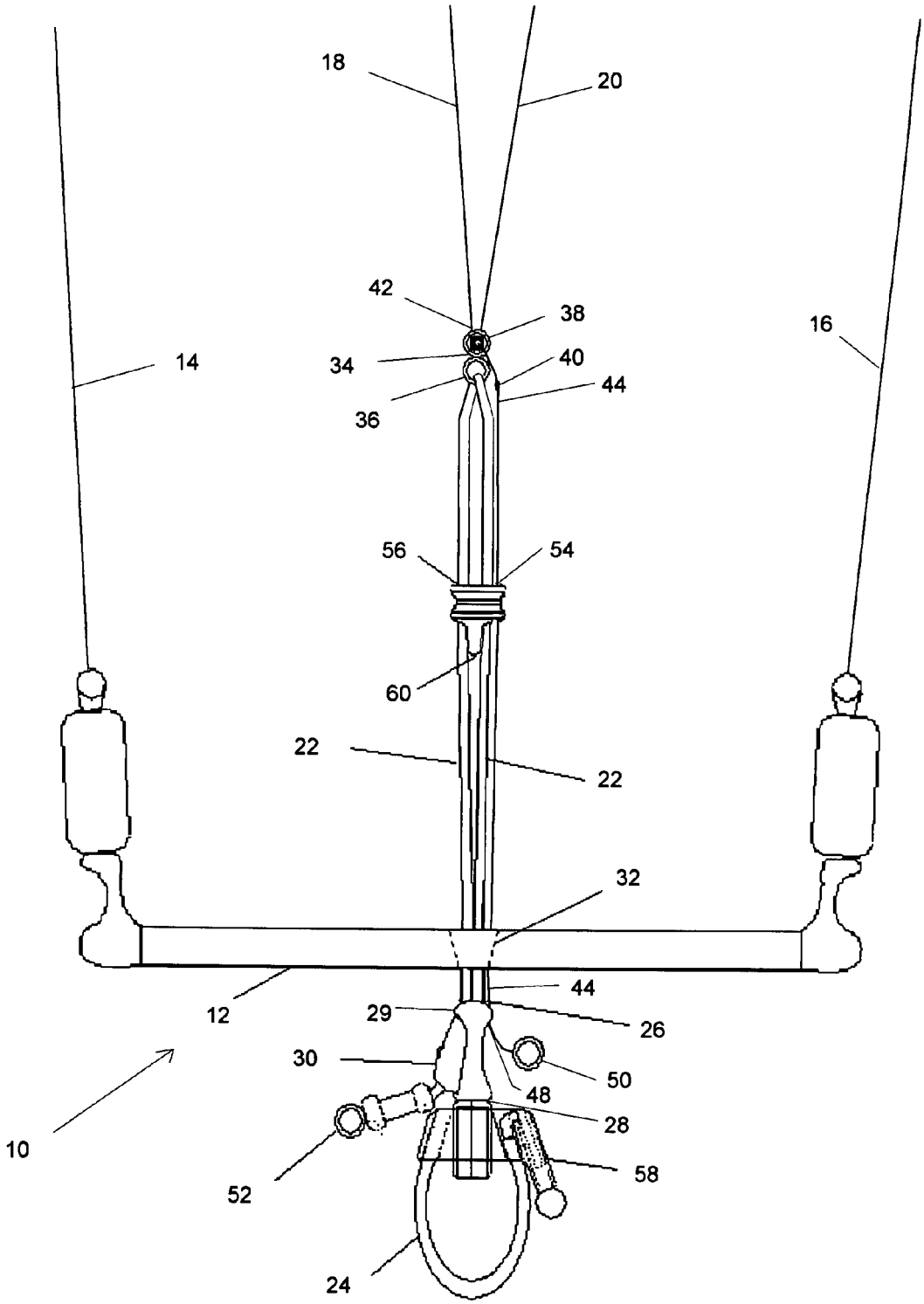
FIG. 1 is a perspective view showing a kite control bar having a center-routed safety system, according to the invention.
Figure 2:
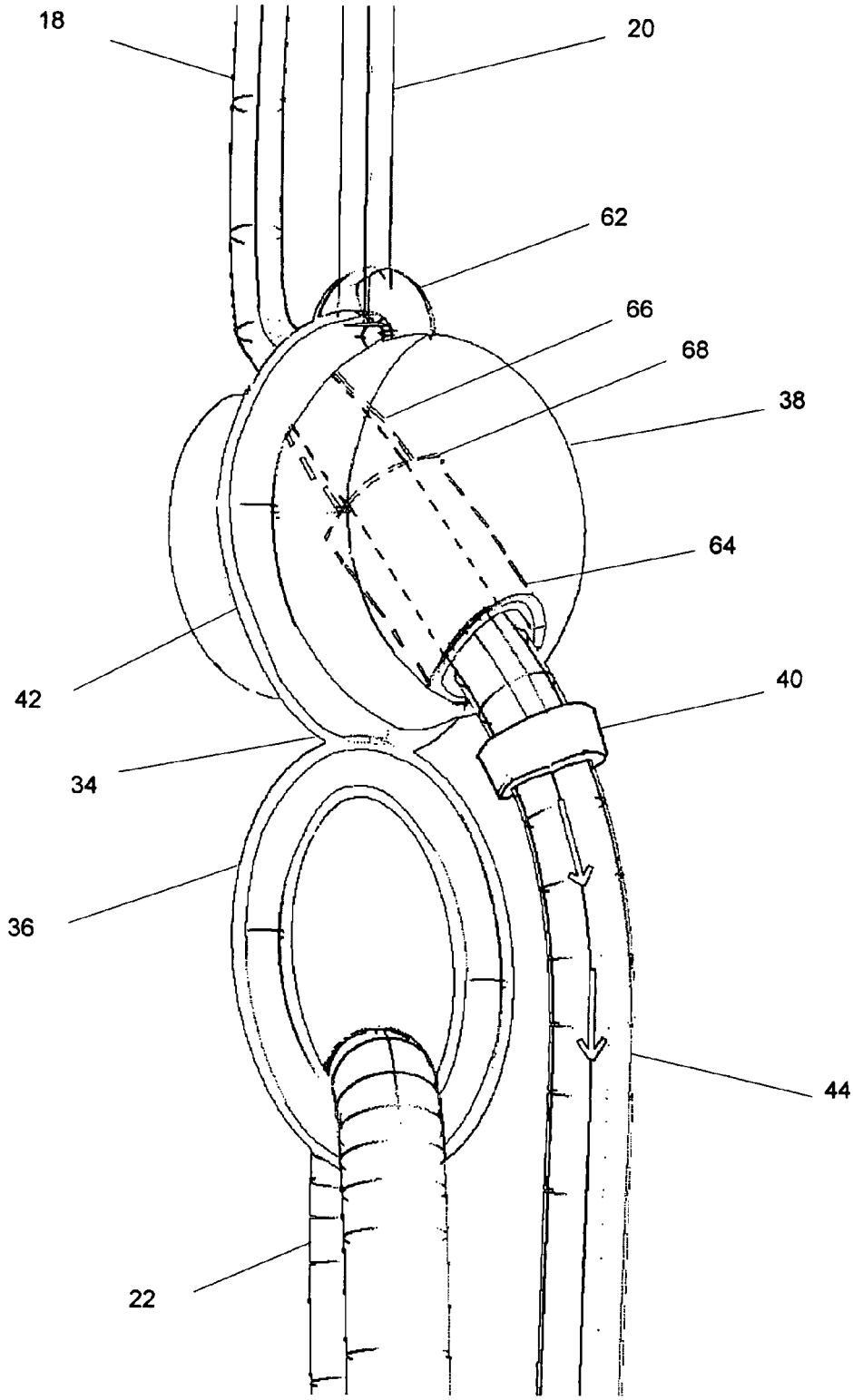
FIG. 2 is a detail view showing the front line safety device of FIG. 1.

FIGS. 1 and 2 illustrate a system 10 including a control device in the form of bar 12, configured to transmit forces to and from steering lines 14 and 16 and front lines 18 and 20 to control a kite. In particular, pivoting bar 12 tensions one steering line and slackens the other, causing the kite to turn. Chicken loop line 22 is secured to chicken loop 24 at end 26 by a swivel attachment 28 to swivel housing 29. A releasable attachment such as cleat 30 provides the fixed trim adjustment and is attached to chicken loop line 22 below the bar. Chicken loop line 22 then passes through aperture 32 in control bar 12. Aperture 32 creates a slidable attachment for chicken loop line 22 to bar 12, and thus can be formed in the control bar 12 or can be in the form of an opening secured to the bar, for example in the form of a fairlead. Further, if desired, multiple apertures can be used such as one for the chicken loop line 22 and one for line extension 44, described below. Accordingly, sliding control bar 12 up and down chicken loop line 22 changes the length of steering lines 14 and 16 relative to front lines 18 and 20 and sheets the kite by changing the angle of attack, dynamically varying the trim.

In the noted embodiment, cleat 30 is attached to chicken loop line 22 via the swivel housing 29 of chicken loop 24. In other embodiments, the releasable attachment can be secured directly to the chicken loop line.

Chicken loop line 22 extends from aperture 32 above the bar to front line safety device 34, which includes a pulley 36 that can be a ring as shown, a traditional wheeled pulley, or any other suitable device that allows chicken loop line 22 to pass without unacceptable friction. Front line safety device 34 also includes a stopper housing 38 that has an aperture 39 configured to allow flying line 18 to move freely in the direction of the control bar 12, but engages an increased diameter element 40 of flying line 18 to provide a positive stop for the flying line when tensioned in the direction of the kite. Front line safety point 24 also includes an attachment 42 for front line 20. In the embodiment shown, front line safety device 34 is in the form of a FIG. 8, with the lower ring forming pulley 26 and the upper ring carrying stopper 38 housing and forming attachment 42 for front line 20.

Front line extension 44 runs from increased line diameter element 40 proximally towards control bar 12. To minimize the potential for tangling, extension 44 runs through an aperture 54 on active stopper 56, keeping line extension 44 grouped with chicken loop line 22. Line extension 44 then extends through aperture 32 on control bar 12 and then through aperture 48 on swivel housing 29, and terminates in ring 50. The user attaches a conventional safety tether to ring 50.

Chicken loop line 22 terminates at end 52. By pulling chicken line 22 via end 52 through cleat 30 and securing it at a desired position, the user can adjust the sheeting range. Swivel attachment 28 allows control bar 12 to be rotated while the user remains attached to chicken loop 24. Accordingly, any twists in the flying lines can be removed by spinning control bar 12 without unhooking from chicken loop 24. Similarly, by routing chicken lines 22 and front line extension 44 through aperture 32, control bar 12 can spin without imparting a twist to these lines. Preferably, chicken loop 24 includes a conventional quick release 58 that opens chicken loop 24 to release the user without having to unhook.

Accordingly, by routing all the lines that extend beyond control bar 12, such as chicken loop lines 22 and front line extension 44 through common aperture 32 in control bar 12, control bar 12 can be spun without imparting twists to those lines. As such, safety system 10 is deployed by transmitting restraining force to one of the flying lines through aperture 32 of control bar 12.

Further details regarding the use of an adjustable fixed trim on a control line positioned between the user and the control bar can be found parent application, U.S. patent application Ser. No. 11/100,911, filed Apr. 6, 2005, which is hereby incorporated by reference in its entirety.

The chicken loop line 22 configuration and cleat 30 can be used in a conventional manner to control the angle of attack of the kite. Generally, a user employs the cleat 30 to adapt the kite to the prevailing wind conditions and moves the control bar 12 up and down chicken loop line 22 to provide immediate control over the kite's angle of attack, allowing the user to spontaneously generate more or less power in the kite as desired. Accordingly, the sheeting angles available by sliding control bar 12 up and down chicken loop line ranges from a minimum established when the bar is fully sheeted in to a maximum that depends upon the throw of the bar along the chicken loop line. Active stopper 56 is used to adjust the amount of throw available, and thus, the range of dynamic trim control. Typically, a control bar is tuned so that maximum power is developed in the kite when a minimum of chicken loop line 22 is drawn through cleat 30, providing the greatest extension of front lines 18 and 20, and when control bar 12 is fully sheeted in to maximize the length of front lines 18 and 20 relative to steering lines 14 and 16. Likewise, the kite has the least amount of power when bar 12 is fully sheeted out and a maximum of chicken loop line 22 is drawn through cleat 30. Therefore, the range of sheeting angles available by sliding control bar 12 up and down chicken loop line 22 can effectively be translocated by drawing a portion of chicken loop line 22 through cleat 30 and securing it.

In use, control bar 12 provides a convenient and adaptable method of controlling a kite. Typically, a user can be secured to chicken loop 24 by a harness hook, shackle or other suitable means and have instantaneous control over the sheeting of the kite simply by moving control bar 12 up and down chicken loop line 22. This range of active sheeting is established as discussed above by drawing more or less chicken loop line 22 through cleat 30 and securing it.

Thus, the control systems of the invention employ a fixed trim adjustment that is located within easy reach of any user and assures that the trim of the kite can be set quickly and accurately. In addition to these benefits, it has been found locating the fixed trim adjustment below the bar minimizes the weight above the bar. This improved weight distribution contributes to an enhanced degree of control and feel. Locating the fixed trim components below the bar positions their weight closer to the center of gravity of the system, that is, the user. In turn, this reduces the swing weight of the control system, making it more responsive. The inventive designs also simplify the bar configuration considerably. Removing the components from the area above the bar reserves that space for the front lines and steering lines, reducing the chance of tangles or other unwanted interaction between the lines.

The safety features of system 10 are enabled by securing line extension 44 to the user, either via ring 50 or through another suitable mechanism. As with conventional safety systems, the user simply unhooks from chicken loop 24 and releases bar 12. Since line extension 44 is secured to the user through a safety tether, once bar 12 is released, increased line diameter element 40 is pulled from stopper housing 38, allowing the bar 12 and remaining flying lines to travel up front line 18, imparting slack to the remaining flying lines. In this configuration, the kite will be functionally restrained only by flying line 18, causing it to "flag" and thoroughly depower. The system is configured to allow sufficient travel of flying line 18 for this to occur. The user resets system 10 simply by taking hold of control bar 12 and pulling it in, which causes front line 18 to be pulled through aperture 39 until increased diameter element 40 engages stopper housing 38. At this point, all the flying lines have been returned to their normal operating length and the kite can be relaunched using conventional techniques.

In a further embodiment, an additional stopper (not shown) can be positioned on front line 18 distal to stopper housing 38. As one having skill in the art will appreciate, such a stopper should be placed so that a sufficient amount of front line 18 can be drawn through the control bar relative to the other flying lines to thoroughly depower the kite. The presence of such a stopper would prevent an excess of front line 18 travel to minimize the risk of tangles and facilitate retrieval of bar 12 once the safety is deployed.

Preferably, chicken loop 24 is configured to allow ready engagement and disengagement with a harness hook worn by the user. Also preferably, chicken loop 24 is attached to chicken loop line 22 by a swivel attachment 28 of swivel housing 29, such as a ball bearing race or other similar mechanism, and is conventionally formed by a tubing reinforced section of line, which will tend to hold the loop in an open position to allow ready engagement with a hook on the user's harness. Alternative configurations of chicken loop 24 can also be employed, such as by terminating chicken loop line 22 with a rigid ring adapted to be retained by a shackle worn by the user, or other suitable methods.

Also preferably, system 10 includes active stopper 56 that allows quick adjustment of the sheeting range. Stopper 56 comprises guides adapted to receive both portions of chicken loop line 22 that extend from pulley 36. The guides allow stopper 56 to be slid relatively freely along chicken loop lines 22, but provide sufficient friction to hold stopper 56 at the desired location when the user is not adjusting the position. Stopper 56 also comprises a wedge portion 60 configured to engage with tapered aperture 32 in control bar 12. Preferably, the surfaces of aperture 32 and wedge 60 have ridges or other features configured to increase friction with chicken loop line 22 when wedge 60 is engaged in aperture 32. In use, stopper 56 can be positioned at any desired position along chicken loop lines 22. When control bar 12 is drawn against stopper 56, wedge 60 engages aperture 32, locking stopper 56 in position along chicken loop lines 22. While in this position, control bar 12 will rest against stopper 56 allowing the kite to remain sheeted at the desired angle without requiring the user to exert a pulling force. When the user does wish to sheet out, the user simply slides stopper 56 to a new position.

In alternative embodiment, stopper 56 can be substituted with a more conventional fixed stopper. As such, the fixed stopper is realeasably secured to the chicken loop line 22 by any suitable mechanism including a screw-actuated fastener, a cam clamp, other friction-based clamps and the like.

Further details regarding sheeting mechanisms and control bar configurations can be found in U.S. patent application Ser. No. 11/267,947, filed Nov. 3, 2005, which is hereby incorporated by reference in its entirety.

FIG. 2 shows a detailed view of front line safety device 34. As discussed above, front line safety device 34 include a pulley in the form of ring 36, a front line attachment point in the form of ring 42 and stopper housing 38. In the shown embodiment, stopper housing 38 is configured to be secured within ring 42, but other arrangement can be used as well. Front line 20 is secured to ring 42 by a lark's head knot 62 or other suitable method of attachment. Stopper housing 38 preferably includes a lumen having large bore 64 and a small bore 66 forming a shoulder 68 within housing 38 (shown in phantom). Front line 18 has an increased diameter element 40, which is configured to conform closely to the diameter of large bore 64. Small bore 66 is configured to allow flying line 18 to travel smoothly within it, but will not allow increased diameter element 40 to pass. Thus, the transition from large bore 64 to small bore 66 forms a shoulder 66 against which increased diameter element 40 positively engages, forming a fixed stop for front line 18. As discussed below, the stopper housing can be any structure having an aperture that prevents increased diameter element 40 from passing.

In the embodiment of the invention shown, increased diameter element 40 is sized to fit snugly within large bore 64. Friction between increased diameter element 40 and large bore 64 causes the flying line to seat itself within stopper housing 38 when tension is applied. Correspondingly, increased diameter element 40 remains seated within housing 38 during normal operation of the kite, even if some slack should develop in front line 18. However, the friction holding increased diameter element 40 within housing 38 is easily overcome when the safety system is deployed, and increased diameter element 40 is pulled from large bore 64 and then sequentially through active stopper 56, control bar 12 and swivel housing 29 so that considerable slack will be imparted to the remaining flying lines and depower the kite.

In other embodiments of the invention, the stopper housing is any structure exhibiting an aperture or tube sized to allow front line 18 to pass but to restrain increased diameter element 40. As described above, preferably the stopper housing additionally comprises a large diameter bore section configured to receive and retain the increased diameter element 40.

As will be appreciated by those having skill in the art, the forces experienced by flying line 18 are considerable, so the interaction between shoulder 68 and increased diameter element 40 must be robust and preferably be able to withstand forces up to the breaking strength of the flying line. In one embodiment of the invention, increased diameter element 40 comprises a knot in the flying line. In other embodiments, increased diameter element 40 is integrally formed in the flying line by weaving a structure into the line. In yet other embodiments, increased diameter element 40 is formed by securing a structure to the line at the desired location.

Although the engagement between increased diameter element 40 and stopper housing 38 must be robust for the reasons given above, it is also desirable to minimize the diameter of increased diameter element 40 to facilitate its passage through the other components of system 10, such as apertures 54, 32 and 48. Accordingly, in a preferred embodiment, increased diameter element 40 is less than approximately 4 times the diameter of flying line 18 (or the minimum diameter of the aperture in stopper housing 38). More preferably, increased diameter element 40 is less than approximately 3 times the diameter of flying line 18 and even more preferably is approximately 2 times the diameter.

Front line extension 44 runs from increased diameter element 40 to the point of attachment to the user, such as ring 50. In some embodiments, front line extension 44 is simply a portion of flying line 18, particularly where increased line diameter element 40 is an integral part formed in the flying line or is a structure attached to the flying line. In other embodiments, front line extension 44 is attached to flying line 18. In a currently preferred embodiment, front line extension 44 is attached to flying line 18 by a conventional loop-to-loop connection that resembles a reef knot and that connection inherently creates the increased diameter element 40. In all embodiments, increased line diameter element 40 has a diameter small enough, and aperture 54 in active stopper 56, aperture 32 in control bar 12 and aperture 48 in swivel housing 29 are all sufficiently sized to allow element 40 to travel smoothly through each passage. This allows the safety system to deploy when the control bar 12 is released from the user and it travels up flying line 18, creating slack in steering lines 14 and 16 and front line 20. Preferably, front line extension 44 is formed from an elasticized material, such as a bungee, so that line extension 44 remains relatively taut regardless of the fixed trim established by adjusting the length of chicken loop line 22 secured by cleat 30. By preventing slack from developing in line extension 44 when chicken loop line 22 is trimmed in, the risk of tangling line extension 44 with the user or other parts of the kite control system is minimized.

Figure 3:
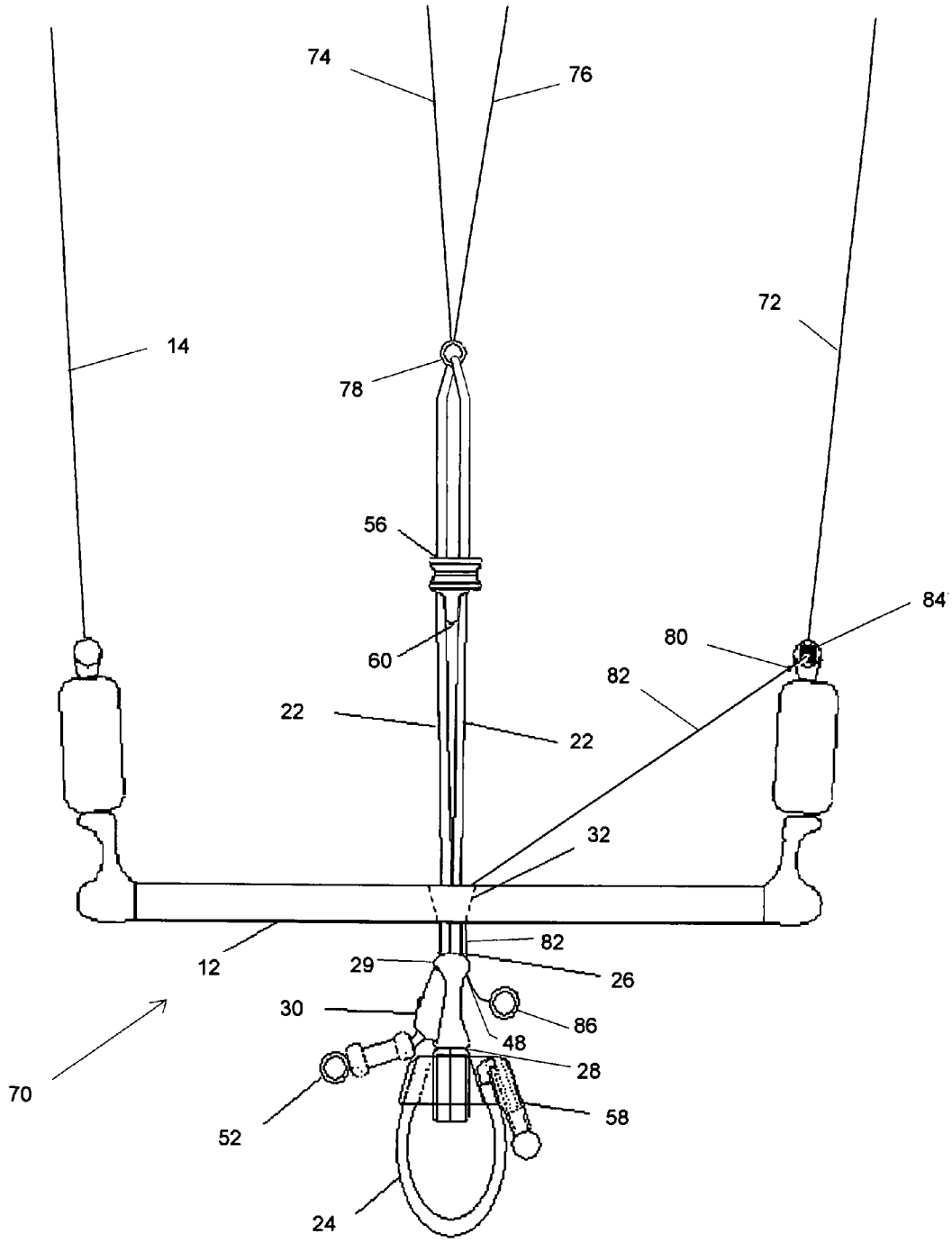
FIG. 3 is a perspective view showing a kite control bar having an alternate embodiment of a center-routed safety system, according to the invention.

In a further embodiment of the invention, shown in FIG. 3, a safety system 70 of the invention is shown that shares many elements in common with safety system 10. In this embodiment, however, a steering line 72 is configured to be restrained when the system is deployed. As such, steering line 14 is conventionally attached to control bar 12 and front lines 74 and 76 are attached to pulley 78. Chicken loop line 22 is routed through pulley 78 in the manner described above to provide fixed trim adjustment. Steering line 72 has an increased diameter element 80 and a steering line extension 82. In this embodiment, stopper housing 84 is secured to one end of control bar 12 and functions to restrain steering line 72 at increased diameter element 80. Steering line extension 82 is routed directly through aperture 32 in control bar 12 and aperture 48 in swivel housing 29. Ring 86 secured to the end of steering line extension 82 provides a convenient attachment point for a user's safety tether.

Operation of system 70 is analogous to that of system 10. During normal operation, increased diameter element 80 engages stopper housing 84, allowing the user to transmit steering forces to the kite in a conventional manner. System 70 is deployed by releasing control bar 12 and chicken loop 24 from the user, while a safety tether remains attached via ring 86. Steering line 72 is pulled through apertures 32 and 48, allowing the control bar to travel up steering line 72 and create significant slack in flying lines 14, 74 and 76 to depower the kite. The system is reset by reattaching the chicken loop and pulling in the control bar, so that increased diameter element 80 reengages stopper housing 84. As with system 10, the force to restrain the flying line is transmitted through the common aperture 32 in control bar 12 to minimize the risk of tangles and twists developing in the flying lines.

Figure 4:
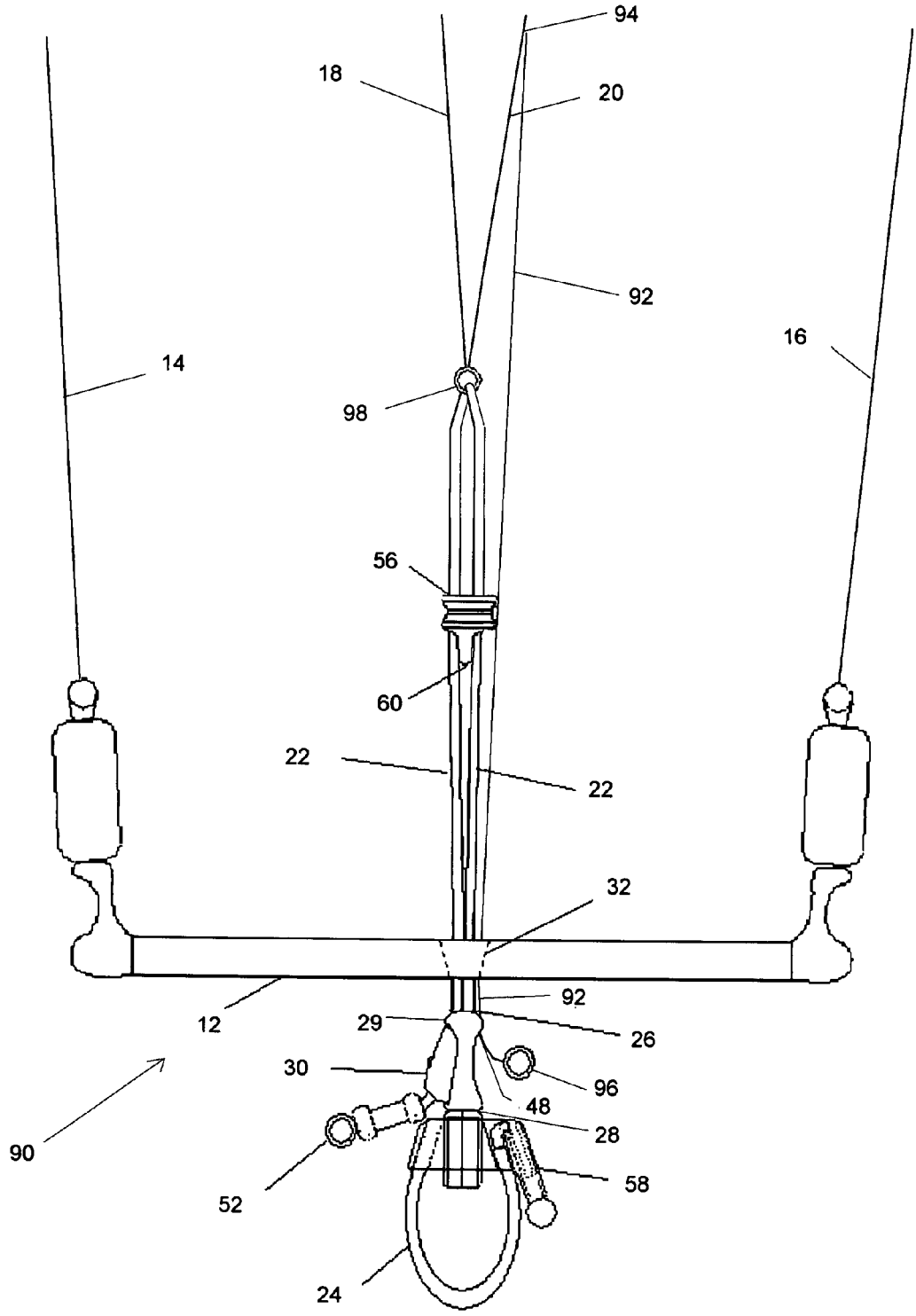
FIG. 4 is a perspective view showing a kite control bar having yet another alternate embodiment of a center-routed safety system, according to the invention.

Another embodiment of the invention is shown in FIG. 4, which primarily features depower line 92 secured to flying line 20 at location 94. Depower line 92 is then routed sequentially through aperture 32 of bar 12 and aperture 48 of swivel housing 29 as described above. Ring 96 secured to the end of depower line 92 provides a convenient attachment point for a user's safety tether. Flying lines 18 and 20 are secured to the chicken loop components described above by ring 98. As will be appreciated by one of skill in the art, location 94 of the attachment of depower line 92 is variable and depends upon the size of the kite, and should be configured to adequately flag the kite when depower line 92 is restrained and bar 12 with the remaining flying lines, 14, 16 and 18 is released. Thus, the location shown in FIG. 4 is not to scale.

During normal flying operation of system 90, flying line 20 is under tension from the kite and depower line 92 does not transmit substantial force to flying line 20. The remaining flying lines 14, 16 and 18 operate conventionally. System 90 is deployed to depower the kite by releasing control bar 12 and chicken loop 24 from the user, while a safety tether remains attached via ring 96. Depower line 92 is pulled through apertures 32 and 48, creating slack on flying lines 14, 16 and 18 relative to flying line 20 which is restrained by the attachment of depower line 92 at location 94. As can be appreciated, location 94 directly controls the amount of slack available and should not be expected to pass through apertures 32 or 48, although that may occur. The slack in flying lines 14, 16 and 18 causes the kite to flag and thoroughly depower. The system is reset by simply reattaching the chicken loop and pulling in the control bar, so that no substantial force is transmitted to flying line 20 by depower line 92 and the slack of flying lines 14, 16 and 18 relative to flying line 20 is removed.

In a further aspect of the invention, the line extensions 44 and 82 or depower line 92, depending upon the embodiment, can be formed from a resilient or elastic material. In such instances, a small amount of tension is present on the line extension or depower line when the kite is in normal flying operation. This minimizes the chances for tangling that could occur if an excess of slack were present. Once the safety system is deployed, however, any range of elasticity is quickly overcome so that the appropriate flying line is restrained. The elasticity can also buffer any initial shock that may occur when the safety system is deployed.

As one of skill in the art will appreciate, the safety systems of the invention can be applied to various kite designs, including C-type kites using four or five control lines, bow type kites, hybrid or supported leading edge (SLE) type kites, and others. For example, the embodiment shown in FIG. 3 could readily be adapted to a two-line controlled kite by omitting the fixed trim adjustment. Further, the center-routed safety of the invention can also be used with conventional fixed trim adjustment systems that use mechanisms located between the bar and the kite to alter the effective length of the chicken loop line. It should also be appreciated that in the principle embodiments illustrated, the center flying lines are secured to the control bar by a chicken loop dynamic trim system. However, the systems of the invention can also be used in configurations wherein the center flying lines are directly attached to the control bar.

Described herein are presently preferred embodiments, however, one skilled in the art that pertains to the present invention will understand that there are equivalent alternative embodiments. As such, changes and modifications are properly, equitably, and intended to be, within the full range of equivalence of the following claims.

What is claimed is:

1. A control device for use with an aerodynamic wing comprising:

a bar with opposing ends adapted to apply steering forces to the aerodynamic wing, first and second flying lines used to transmit forces to and from the aerodynamic wing, and a stopper housing secured to the control device, wherein the first flying line independently and slidably extends from the aerodynamic wing through the stopper housing and is then routed through an aperture in the bar, wherein the second flying line is secured to the stopper housing, and wherein an increased diameter element on the first flying line is positioned proximally of the stopper housing and is configured to engage the stopper housing and prevent travel of the increased diameter element through the stopper housing to prevent distal movement of the first flying line but is configured to travel through the aperture on the bar so that the first flying line can travel in a proximal direction through the stopper housing and the aperture.

2. The control device of claim 1, wherein the stopper housing has a large bore portion and a small bore portion, wherein the small bore portion prevents travel of the increased diameter element through the stopper housing.

3. The control device of claim 2, wherein the large bore portion is configured to engage the increased diameter element of the first flying line with friction and releasably retain the increased diameter element.

4. The control device of claim 1, wherein the increased diameter portion of the first flying line is less than approximately four times the diameter of the first flying line.

5. The control device of claim 4, wherein the increased diameter portion of the first flying line is approximately two times the diameter of the first flying line.

6. The control device of claim 5, wherein the first flying line is configured to be secured to a leading edge of the aerodynamic wing at a first location adjacent a first end, further comprising a second flying line configured to be secured to the leading edge at a second location opposing the first location.

7. The control device of claim 1, further comprising third and fourth flying lines, wherein the four flying lines comprise two steering lines disposed at the opposing ends of the bar and two front lines.

8. The control device of claim 7, wherein the control device further comprises a chicken loop line extending through the aperture on the bar and secured to the front lines.

9. The control device of claim 8, wherein effective length of the chicken loop line is adjustable.

10. The control device of claim 9, wherein the chicken loop line and the front lines are connected by a front line attachment.

11. The control device of claim 10, wherein the front line attachment further comprises the stopper housing.

12. The control device of claim 11, wherein the chicken loop line is secured to a chicken loop, travels through the aperture on the bar, through a pulley above the bar to which the front lines are secured, back through the aperture and is secured by a releasable attachment located adjacent the chicken loop, wherein the front line attachment further comprises the pulley.

13. The control device of claim 12, wherein the chicken loop line is secured to the chicken loop by a housing and the releasable attachment is secured to the housing, and wherein the housing comprises an aperture through which the first flying line extends.

14. The control device of claim 13, further comprising a stopper running along the chicken loop line and wherein the stopper has an aperture through which the first flying line extends.

15. A method for controlling an aerodynamic wing comprising the steps of:

a) providing a control device according to claim 1;

b) attaching a safety tether between the user and the first flying line to restrain the first flying line; and c) depowering the aerodynamic wing by releasing the bar so that the first flying line runs through the stopper housing and the aperture to create slack in the second flying line.

16. The method of claim 15, further comprising the step of pulling in the bar so that the first flying line travels through the aperture in the stopper housing until the increased diameter element of the flying line engages the stopper housing and allows normal control of the aerodynamic wing.

* * * * *